US005788424A

United States Patent [19]

Torch

[11] Patent Number: 5,788,424

[45] Date of Patent: Aug. 4, 1998

[54] RETAINING WALL UNITS AND RETAINING WALLS CONTAINING THE SAME

[76] Inventor: Joe Torch, 1 S. Baltimore Dr., Mystic Island, N.J. 08087

[21] Appl. No.: 640,523

[22] Filed: May 1, 1996

[51] Int. Cl.[6] ..... E02D 29/02; E02D 5/00

[52] U.S. Cl. ..... 405/286; 405/262; 405/284

[58] Field of Search ..... 405/284, 285, 405/286, 272, 273, 258, 262

[56] References Cited

U.S. PATENT DOCUMENTS

| | | | |
|---|---|---|---|
| 4,117,686 | 10/1978 | Hilfiker . | |
| 4,341,491 | 7/1982 | Neumann | 405/284 X |
| 4,379,659 | 4/1983 | Steiner . | |
| 4,514,113 | 4/1985 | Neumann . | |
| 4,728,227 | 3/1988 | Wilson et al. . | |
| 4,825,619 | 5/1989 | Forsberg . | |
| 4,856,939 | 8/1989 | Hilfiker . | |
| 4,914,887 | 4/1990 | Meheen | 405/284 |
| 4,920,712 | 5/1990 | Dean, Jr. . | |
| 4,923,339 | 5/1990 | Smith . | |
| 4,952,098 | 8/1990 | Grayson et al. . | |
| 4,961,673 | 10/1990 | Pagano et al. | 405/284 X |
| 4,964,761 | 10/1990 | Rossi . | |
| 4,968,186 | 11/1990 | Ogorchock . | |
| 5,062,610 | 11/1991 | Woolford et al. . | |
| 5,066,169 | 11/1991 | Gavin et al. . | |
| 5,163,261 | 11/1992 | O'Neill . | |
| 5,174,688 | 12/1992 | Meheen . | |
| 5,257,880 | 11/1993 | Janopaul, Jr. . | |
| 5,294,216 | 3/1994 | Sievert . | |
| 5,320,455 | 6/1994 | Mattox | 405/284 |
| 5,333,970 | 8/1994 | Heselden | 405/286 |
| 5,505,563 | 4/1996 | Curt | 405/284 X |

*Primary Examiner*—Dennis L. Taylor
*Attorney, Agent, or Firm*—Watov & Kipnes, P.C.

[57] ABSTRACT

A retaining wall unit and retaining wall made from the retaining wall units wherein the retaining wall unit includes a support structure such as a meshlike enclosure for holding an anchoring medium such as rocks therein, a slab having a stone face and a rearward face for attachment to the support structure and an optional securing device such as a snap-lock device which enables the slab to be releasably secured to the support structure.

9 Claims, 3 Drawing Sheets

RETAINING WALL UNITS AND RETAINING WALLS CONTAINING THE SAME

FIELD OF THE INVENTION

The present invention is directed to retaining wall units and to retaining walls made from the same in which gabion-type structures are used to support stone slabs to form decorative retaining walls.

BACKGROUND OF THE INVENTION

Retaining walls are provided for the prevention of soil loss by erosion or to prevent an embankment (i.e. a sloped area of earth) from sliding forward. The retaining wall must provide sufficient support to hold back large volumes of earth behind it.

Retaining walls have been fabricated as large reinforced concrete structures which are very heavy and costly. Such systems are often employed in areas where embankments are steep and/or falling debris is commonplace. Concrete retaining walls are typically very expensive to fabricate and the cost is prohibitive particularly for residential locales.

It is known in the art to provide inexpensive retaining walls through the use of gabions. Gabions are basket-like structures which can be filled with rock to provide permeable retaining walls. These permeable walls allow the passage of water to prevent the build-up of hydrostatic pressure which can adversely affect the structure of the retaining wall. Gabions have been constructed of wire mesh because of their relatively inexpensive cost and ease of use. An example of a gabion type retaining wall is disclosed in William K. Hilfiker, U.S. Pat. No. 4,117,686, incorporated herein by reference. This patent discloses the use of trays of steel wire fabric sheets with filtering rocks and/or mats placed toward the front of the wall and against the bent up face section, with soil being placed to the rear of the tray.

Gabion type retaining walls are particularly useful for commercial locales such as roadsides, river embankments and the like. However, the wire mesh facing of gabion type retaining walls provides an unacceptable appearance for residential locales. Therefore, the residential market has sought to develop retaining walls having decorative front stone faces which are secured to the earth behind it through some form of anchoring means. Examples of such systems are disclosed, for example, in Albert Neumann, U.S. Pat. No. 4,514,113; Boyd H. Grayson et al., U.S. Pat. No. 4,952,098 and John M. Ogorchock, U.S. Pat. No. 4,968,186, each of which is incorporated herein by reference.

Each of these retaining wall systems include a front wall, typically having a decorative stone face with an anchoring device attached to the stone and secured rearwardly into the earth behind the stone face. Such systems are typically disadvantageous because they are expensive to construct, take up a lot of space while being stored prior to installation and/or are difficult to secure to the ground. Relief from hydrostatic pressure in such systems generally requires the incorporation of permeable materials behind the structure, thereby requiring additional material such as the building of an additional wall. In addition, such retaining wall systems do not provide a cost efficient and effective means of replacing damaged stone faces.

It will be understood that retaining walls are often built in a tiered structure. Individual retaining wall units are arranged in rows and the rows stacked one upon the other to form multiple tiers typically ranging from 2 to 10 feet high in residential locales. The stone slabs having a decorative outer face, while able to withstand the forces of nature and changes in climate, nonetheless, do crack over time and can be otherwise damaged when impacted by heavy objects. In the past, the replacement of individual stone slabs has required replacement of multiple retaining wall units or at times a portion of the entire retaining wall. Quite obviously, the cost of replacement can be cost prohibitive and unacceptable for residential locales.

It would therefore be a significant advance in the art of retaining walls to develop a retaining wall system comprised of individual retaining wall units which provide decorative stone faces suitably anchored to the earth which are relatively less expensive to construct and/or can be replaced in a cost effective and efficient manner. One benefit of such systems is that a plurality of front slabs can be attached to the same support structure. This enables the slabs and support structures to be stored separately which reduces the storage area.

SUMMARY OF THE INVENTION

The present invention is generally directed to a retaining wall comprised of individual retaining wall units having stone faces forming the wall and means for anchoring the slabs in a manner which provides the benefits of a permeable wall construction with the acceptable appearance of a decorative front face constructed as a single unit.

In particular, one aspect of the present invention is directed to a retaining wall unit and to retaining walls formed by the same in which the retaining wall unit comprises:

a) a support structure in the form of a meshlike enclosure for holding an anchoring medium therein and having a front face; and b) a stone slab having a front face and a body portion having the front face of the support operatively attached thereto.

In another aspect of the present invention, the retaining wall unit and retaining walls formed from the same comprise:

a) a support structure for holding an anchoring medium therein and having a front face;

b) a slab having a front face and a body portion for releasable attachment to the front face of the support structure; and c) securing means for releasably securing the body portion of the slab to the front face of the support structure.

BRIEF DESCRIPTION OF THE DRAWINGS

The following drawings in which like reference characters indicate like parts are illustrative of embodiments of the invention and are not to be construed as limiting the invention as encompassed by the claims forming part of the application.

DETAILED DESCRIPTION OF THE INVENTION

The present invention is generally directed to a retaining wall unit constructed in a manner that provides a permeable support structure attached to a decorative stone slab. The retaining wall unit is constructed with the advantage of gabion-type support but with the aesthetic appeal required for residential locales. In addition, the retaining wall unit may be constructed in a manner which allows ready replacement of a single stone slab without disrupting undamaged retaining wall units. The cost efficient and effective manner by which these units are constructed and by which the individual retaining wall units can be replaced makes retaining walls constructed with such retaining wall units especially suitable for residential use.

Figure 1:
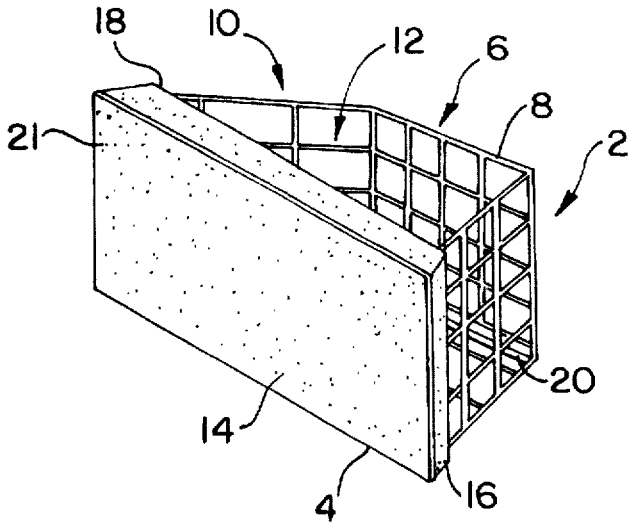
FIG. 1 is a perspective view of one embodiment of a retaining wall unit in accordance with the present invention in which the support structure is embedded into the slab.
Figure 2:
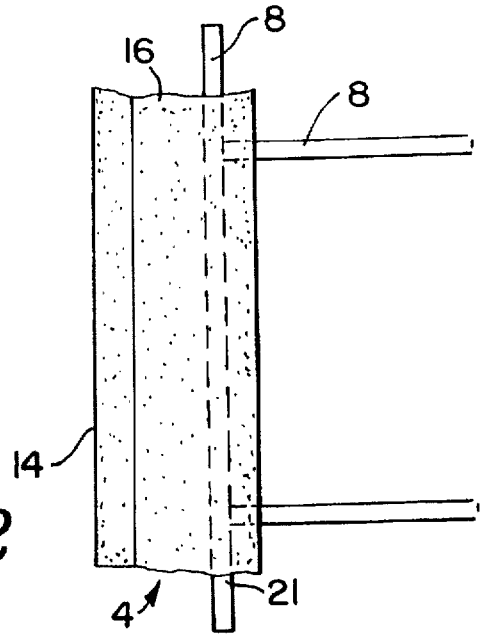
FIG. 2 is a partial side view of the retaining wall unit shown in FIG. 1.

Referring to FIGS. 1 and 2, a retaining wall unit 2 of the present invention includes a front facing slab 4 and a rearward support structure 6 shown in the form of a wire mesh enclosure 8 having a top open end 10 defining a chamber 12 for holding an anchoring medium such as rocks and the like therein. The anchoring medium is preferably a medium such as rocks which define pathways through which a liquid (e.g. groundwater) may enter and leave (i.e. is liquid permeable). As illustrated herein, reference is made to a wire mesh enclosure. It will be understood that rigid plastics such as polypropylene and the like may be used such as in the form of plastic milkcrates.

The slab 4 includes a front face 14 which typically is made of aesthetically appealing decorative stone. As used herein the term stone or decorative stone face shall mean any stone face including plain concrete which can be used to provide an acceptable appearance to the retaining wall. Examples include smooth concrete, stone embedded in concrete, embossed concrete and the like.

Rearward of the front face 14 is a substrate 16 which may be made of the same stone as the front face 14 or, for economical reasons, is preferably made of concrete. The substrate 16 has a rearward face 18 which is adapted to interface with the support structure 6 as hereinafter described. The substrate 16 provides support for the front face 14 and a point of attachment for the slab to the support structure 6.

The wire mesh enclosure 8 may optionally be provided with a set back bar 20 which allows the installer to maintain the correct angle that the retaining wall should lean into the embankment. The wire mesh enclosure can vary in size such as for example 2 feet wide, 1 foot high and 1 foot deep.

As shown specifically in FIGS. 1 and 2, the support structure 6 in the form of a wire mesh enclosure 8 may be embedded in the substrate portion 16 of the slab 4. The front face 21 of the wire mesh enclosure 8 lies within the substrate 16 (see especially FIG. 2) and is thereby secured to the slab 4. Embedding of the wire mesh enclosure 8 in the slab 4 can be accomplished by forming the substrate 16 in a mold and placing the front face 21 of the enclosure 8 within the substrate 16 as it begins to harden. This procedure is particularly useful when the substrate 16 is concrete.

Figure 3:
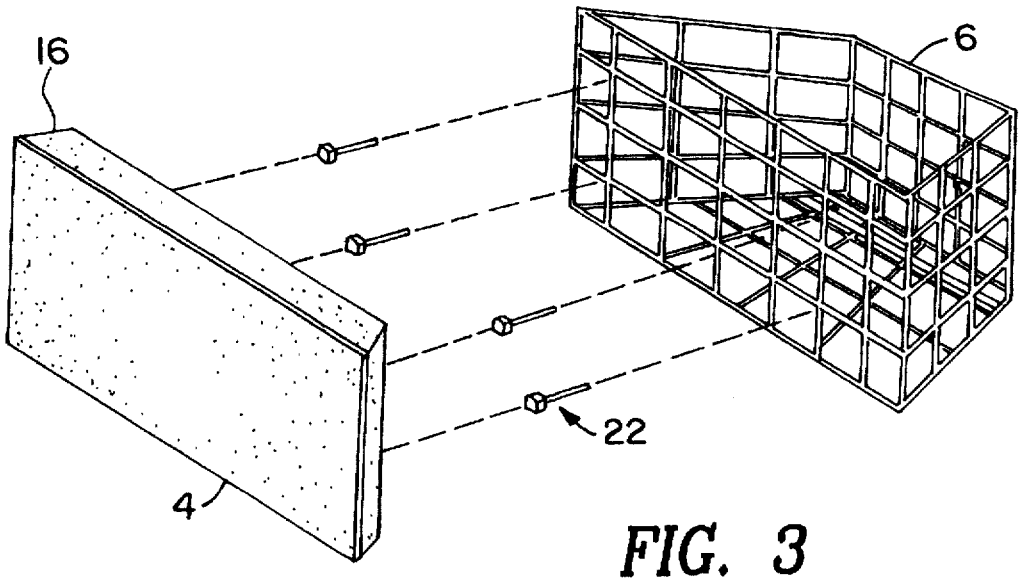
FIG. 3 is an exploded view of another embodiment of the present invention in which the slab is secured to the support structure through a bolting device.
Figure 4:
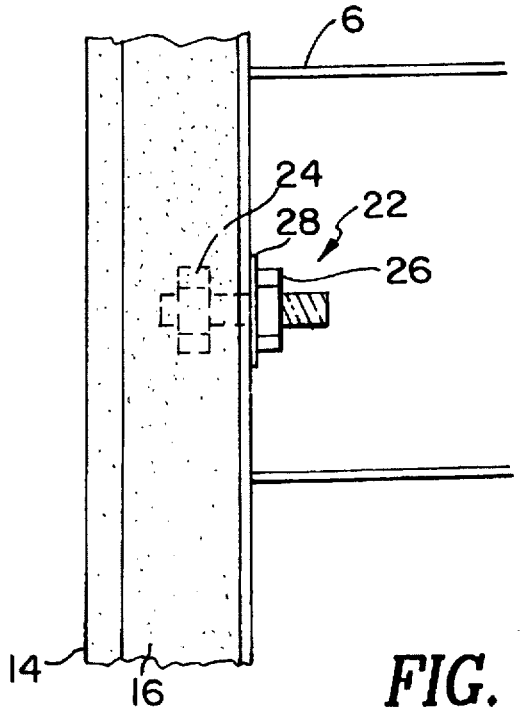
FIG. 4 is a partial side view of the embodiment shown in FIG. 3.

In another embodiment of the present invention, the slab 4 is secured to the support structure 6 by alternative means such as by a bolting device and a snap-lock assembly. Referring specifically to FIGS. 3 and 4, there is shown a first embodiment of the securing means in the form of a bolting device shown generally by numeral 22. The bolting device includes a bolt 24, a nut 26 and an optional washer 28 as shown best in FIG. 4. The bolt 24 is secured within the substrate 16. The nut 26 and optional washer 28 enable the bolting device 22 to rigidly secure the support structure 6 (e.g. wire mesh enclosure 8) to the substrate 16 to thereby form an integral connection between the support structure 6 and the slab 4.

Figure 5:
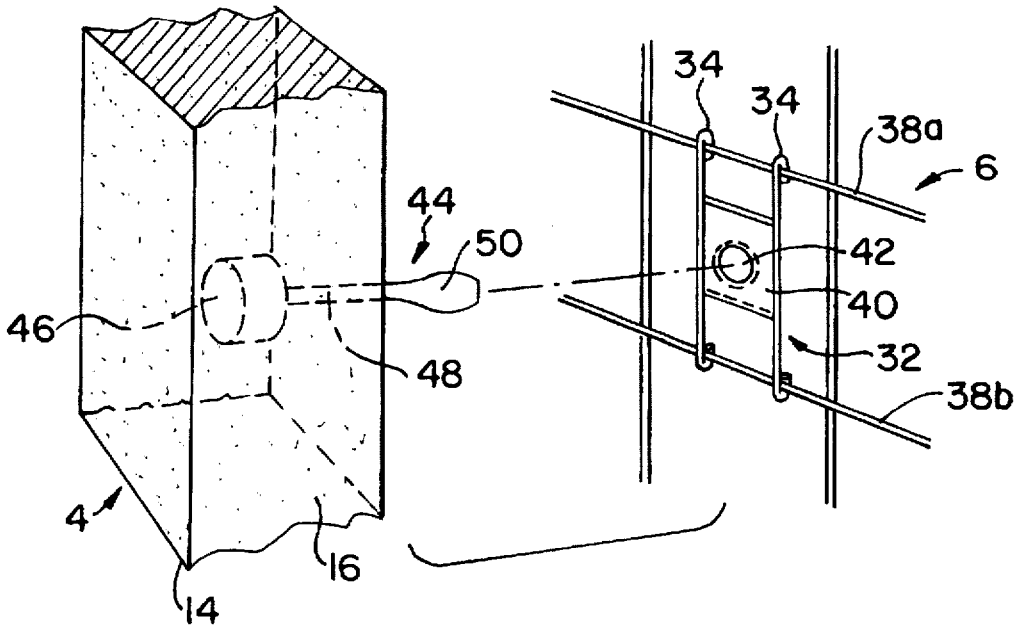
FIG. 5 is an exploded view of another embodiment of the present invention in which the securing means is a snap-lock assembly for releasably securing the slab to the support structure.

FIG. 5 shows an alternative securing device employing a snap-lock assembly 30. The snap-lock assembly 30 includes a connector 32 operatively secured to the wire mesh enclosure 8. The connector 32 includes a pair of spaced apart legs 34 having opposed ends 36 secured to wires 38*a* and 38*b* of the wire mesh enclosure 8. In this embodiment of the invention, the slab 4 can be removed from its attachment to the support structure 6 as hereinafter described.

The legs 34 are respectively connected to a flexible spacer 40 having a centrally positioned opening 42 for receiving a fastener 44 as hereinafter described. The fastener 44 is operatively connected to the slab 4 and has a base 46 secured within the substrate 16 of the slab 4. Extending from the base 46 is an arm 48 having a projection 50 with a shape suitable for insertion into the opening 42 of the connector 32. When the slab 4 is pulled outwardly, the fastener 44 is disengaged from the connector 32 by removal of the projection 50 from the opening 42. A new slab can then be operatively attached to the support structure (e.g. snapped into place) by inserting the projection 50 thereof into the flexible spacer 40 through the opening 42.

Figure 6:
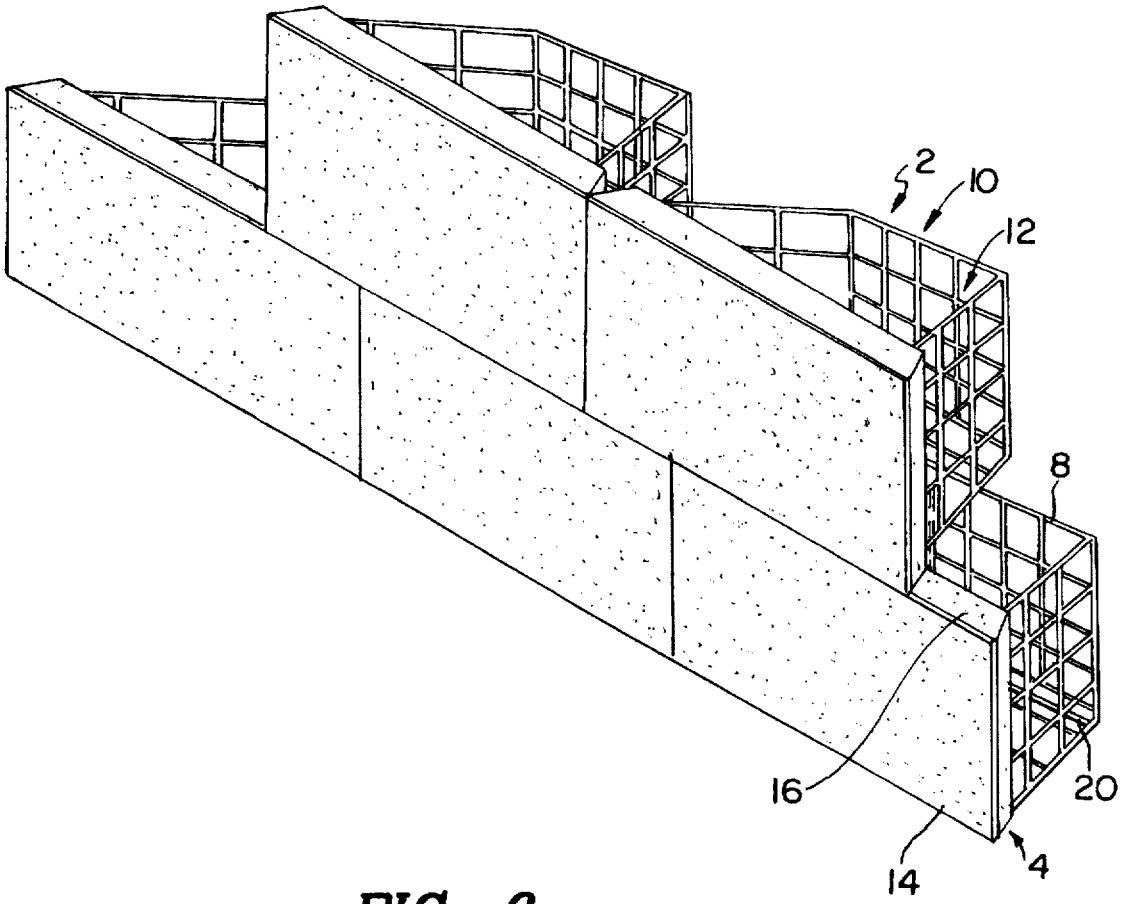
FIG. 6 is a perspective view of a retaining wall employing retaining wall units of the present invention.

The retaining units 2 of the present invention can be arranged so as to form a retaining wall of the type shown in FIG. 6. Referring to FIG. 6, individual retaining wall units 2 are placed side by side to form a tier. Multiple tiers are typically provided to form the retaining wall. As shown in FIG. 6, it is customary to recess an upper successive tier as it is placed about a lower tier to provide maximum support and balance for the retaining walls.

What is claimed is:

1. The retaining wall unit comprising:

a) a support structure in the form of a meshlike enclosure for holding an anchoring medium therein, said support structure having a front face for operative engagement with a stone slab structure and at least one earth contacting face wherein said contact is solely through the pressure applied by the anchoring medium loaded into the meshlike enclosure;

b) a stone slab structure comprising a front face and a body portion; and c) securing means for securing the stone slab structure to the support structure through the body portion, said retaining wall unit being arrangeable in stackable rows to form a retaining wall and being individually removable from the retaining wall for replacement thereof.

2. The retaining wall unit of claim 1 wherein the meshlike enclosure is a basket made of wire or plastic.

3. The retaining wall unit of claim 2 wherein the meshlike enclosure is in the form of a cube-shaped plastic milkcrate.

4. The retaining wall unit of claim 2 wherein the anchoring medium when loaded into the meshlike enclosure defines pathways through which a liquid may enter and leave the meshlike enclosure.

5. A retaining wall comprising at least one row of the retaining wall units of claim 1.

6. The retaining wall unit of claim 2 wherein the meshlike enclosure has a top open end for receiving said anchoring medium.

7. The retaining wall unit of claim 1 wherein the securing means is a snap-like device.

8. The retaining wall unit of claim 1 wherein the slab comprises a stone front face and a rearward facing substrate, said substrate operatively connected to the support structure.

9. The retaining wall unit of claim 8 wherein the substrate is made of concrete.

* * * * *